US012523413B2

(12) United States Patent
Dong et al.

(10) Patent No.: US 12,523,413 B2
(45) Date of Patent: Jan. 13, 2026

(54) REFRIGERATOR DOOR ASSEMBLY, REFRIGERATOR, AND INTEGRATED CUPBOARD

(71) Applicants: QINGDAO HAIER REFRIGERATOR CO., LTD., Qingdao (CN); HAIER SMART HOME CO., LTD., Qingdao (CN)

(72) Inventors: Yufeng Dong, Qingdao (CN); Enpin Xia, Qingdao (CN); Hao Zhang, Qingdao (CN)

(73) Assignees: QINGDAO HAIER REFRIGERATOR CO., LTD., Qingdao (CN); HEIR SMART HOME CO., LTD., Qingdao (CN)

( * ) Notice: Subject to any disclaimer, the term of this patent is extended or adjusted under 35 U.S.C. 154(b) by 96 days.

(21) Appl. No.: 18/575,660

(22) PCT Filed: May 30, 2022

(86) PCT No.: PCT/CN2022/096035
§ 371 (c)(1),
(2) Date: Dec. 29, 2023

(87) PCT Pub. No.: WO2023/273764
PCT Pub. Date: Jan. 5, 2023

(65) Prior Publication Data

US 2024/0310107 A1 Sep. 19, 2024

(30) Foreign Application Priority Data

Jun. 30, 2021 (CN) ..... 202110739344.4

(51) Int. Cl.
*F25D 23/02* (2006.01)

(52) U.S. Cl.
CPC ..... *F25D 23/02* (2013.01)

(58) Field of Classification Search
CPC ..... F25D 23/028; F25D 23/02; F25D 23/10; F25D 2400/18; A47B 2096/208
See application file for complete search history.

(56) References Cited

U.S. PATENT DOCUMENTS 5,083,443 A * 1/1992 von Blanquet ..... F25D 23/003 62/428
6,036,292 A 3/2000 Mandel et al.
(Continued)

FOREIGN PATENT DOCUMENTS

CN 1677033 A 10/2005
CN 203531332 U 4/2014
(Continued)

*Primary Examiner* — Bradley Duckworth
(74) *Attorney, Agent, or Firm* — MUNCY, GEISSLER, OLDS & LOWE, P.C.

(57) ABSTRACT

A refrigerator door assembly, a refrigerator, and an integrated cupboard. The refrigerator door assembly (100) comprises a refrigerator door (10), a front baffle (20), and a kick plate (30); the front baffle (20) is provided at a lower end of the refrigerator door (10) and located at an outer side of the refrigerator door (10); and the kick plate (30) is provided on one side of the front baffle (20) away from the refrigerator door (10) and connected to the front baffle (20), to move with the refrigerator door (10) when the refrigerator door (10) opens.

8 Claims, 5 Drawing Sheets

(56) References Cited

U.S. PATENT DOCUMENTS

| | | | | |
|---|---|---|---|---|
| 9,599,394 | B2 * | 3/2017 | Kobos | B23P 19/00 |
| 11,035,163 | B2 * | 6/2021 | Braden | E05D 3/022 |
| 2005/0218764 | A1 * | 10/2005 | Hong | F25D 23/00 312/265.5 |
| 2021/0007481 | A1 | 1/2021 | Kim | |
| 2023/0251022 | A1 * | 8/2023 | Li | F25D 23/028 49/501 |

FOREIGN PATENT DOCUMENTS

| | | | |
|---|---|---|---|
| CN | 106618427 | A | 5/2017 |
| CN | 211110822 | U | 7/2020 |
| CN | 215892931 | U | 2/2022 |
| FR | 2610091 | A3 | 7/1988 |
| JP | 2000320952 | A | 11/2000 |
| JP | 5743699 | B2 | 7/2015 |

* cited by examiner

REFRIGERATOR DOOR ASSEMBLY, REFRIGERATOR, AND INTEGRATED CUPBOARD

TECHNICAL FIELD

The present invention relates to a field of refrigerators, and in particular, to a refrigerator door assembly, a refrigerator, and an integrated cupboard.

BACKGROUND

In prior arts, a refrigerator embedded in a cupboard requires the installation of a base cupboard at the bottom of the cupboard, and a kick plate is installed on the front side of the base cupboard, and the refrigerator is placed on the top of the base cupboard. Therefore, the bottom of a refrigerator door needs to be set higher than the kick plate to enable free opening of the refrigerator door. This arrangement, compared to a floor-standing refrigerator, results in a smaller depth and, at the same height, a smaller storage space inside the refrigerator, and it will also raise the height at which the refrigerator is positioned, making it inconvenient for users and resulting in a poorer user experience.

SUMMARY

The first aspect of the present invention aims to provide a refrigerator door assembly to solve the technical problem that an embedded refrigerator in the prior art has a high height that affects the user experience due to the arrangement of the kick plate.

A further object of the first aspect is to prevent the kick plate from sliding down.

The second aspect of the present invention aims to provide a refrigerator comprising the aforementioned refrigerator door assembly.

The third aspect of the present invention aims to provide an integrated cupboard comprising the aforementioned refrigerator.

According to the object of the first aspect of the present invention, the present invention provides a refrigerator door body assembly, comprising:

a refrigerator door;

a front baffle, provided at a lower end of the refrigerator door and located on an outside of the refrigerator door;

a kick plate, provided on one side of the front baffle away from the refrigerator door and connected to the front baffle, to move with the refrigerator door when it opens.

Optionally, the kick plate is detachably connected to the front baffle, and the kick plate is connected to the front baffle either directly or via at least one clip; the installation position of the front baffle is adjustable along a thickness direction and a height direction of the refrigerator door.

Optionally, a surface of the front baffle away from the refrigerator door is provided with at least one protrusion, and the protrusion is provided with a first gear structure on each side along the width direction of the refrigerator door; the surface of the kick plate facing the front baffle has a catch portion provided in one-to-one correspondence with each protrusion, and each of catch portions is provided with a second gear structure that cooperates with the first gear structure to realize the connection of the front baffle and the kick plate through the combination of the first gear structure and the second gear structure.

Optionally, a surface of a side of the front baffle away from the refrigerator door is provided with at least one recessed first slide groove, each first slide groove is correspondingly set with the protrusion, and the protrusion is located within the first slide groove.

Optionally, the first gear structure and the second gear structure are configured to only allow the kick plate to move upwards relative to the front baffle.

Optionally, a surface of the front baffle away from the refrigerator door is provided with at least one protrusion, and the protrusion is provided with a first gear structure on each side along the width direction of the refrigerator door; each clip is correspondingly set with each protrusion, and a surface of a side of the clip facing the front baffle is provided with a groove, the groove is provided with a third gear structure that cooperates with the first gear structure to realize the connection between the clip and the front baffle through the combination of the first gear structure and the third gear structure; the clip is provided with a slider on a surface of a side of the clip backing away from the front baffle, and the kick plate has a second slide groove that cooperates with the slider to realize the connection of the kick plate with the clip through the engagement of the slider and the second slide groove.

Optionally, the kick plate is configured to cover the front baffle after being connected with the front baffle.

Optionally, the protrusion is provided with a limiting block, which protrudes from a side surface provided with the first gear structure; the catch portion is provided with a first limiting slot that cooperates with the limiting block, used to restrict the position of the kick plate relative to the front baffle when the kick plate moves to abut the limiting block at the first limiting slot.

According to the object of the second aspect of the present invention, the present invention also provides a refrigerator, the refrigerator is equipped with the refrigerator door assembly as described above.

According to the object of the third aspect of the present invention, the present invention also provides an integrated cupboard, comprising: a cupboard body, and the refrigerator as described above, and when the refrigerator door assembly of the refrigerator is in the closed state, its kick plate is flush with or recessed into the kick plates of the cupboard bodies on both sides.

The present invention includes a refrigerator door, a front baffle and a kick plate, the front baffle is provided at a lower end of the refrigerator door and located on an outside of the refrigerator door. The kick plate is provided on one side of the front baffle away from the refrigerator door and is connected to the front baffle, to move with the refrigerator door when it opens. This arrangement does not affect the placement height of the refrigerator and, at the same height, offers more storage space in the refrigerator, and enhances user experience and satisfaction.

BRIEF DESCRIPTION OF THE DRAWINGS

The subsequent sections will describe some specific embodiments of the present invention in a detailed and non-limiting manner with reference to the drawings. The same reference numerals in the drawings denote the same or similar parts or components. It should be understood by those skilled in the art that these drawings are not necessarily drawn to scale. In the drawings.

DETAILED DESCRIPTION

This section of the document describes specific embodiments of the present invention, illustrating them through accompanying drawings. The same or similar components, or those with identical or similar functions, are represented by consistent or similar designations throughout the document. The described embodiments are intended to explain the invention and should not be construed as limiting.

Figure 1:
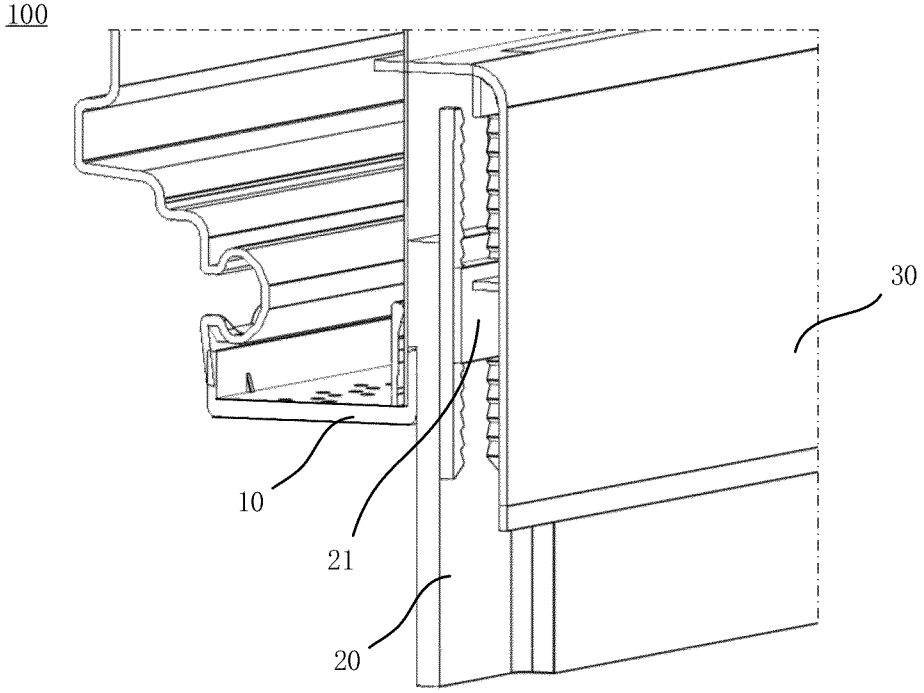
FIG. 1 is a schematic structural view of a refrigerator door assembly according to an embodiment of the present invention.

FIG. 1 shows a schematic structural view of a refrigerator door assembly 100 according to the present invention. As shown in FIG. 1, in a specific embodiment, the refrigerator door assembly 100 includes a refrigerator door 10, a front baffle 20, and a kick plate 30. The front baffle 20 is provided at a lower end of the refrigerator door 10 and located on an outside of the refrigerator door 10. The kick plate 30 is provided on one side of the front baffle 20 away from the refrigerator door 10 and is connected to the front baffle 20, to move with the refrigerator door 10 when it opens. This arrangement does not affect the placement height of the refrigerator and, at the same height, offers more storage space in the refrigerator, and enhances user experience and satisfaction.

Further, the kick plate 30 is detachably connected to the front baffle 20, and the kick plate 30 is connected to the front baffle 20 either directly or via at least one clip, thereby facilitates easy replacement in case of damage or malfunction of the kick plate 30.

Additionally, the position of the front baffle 20 along a thickness direction and a height direction of the refrigerator door 10 is adjustable. Specifically, the refrigerator door 10 is provided with multiple elongated holes in the height direction, so as to adjust the position of the front baffle 20 relative to the refrigerator door 10 (both forward-backward and up-down adjustments).

Figure 2:
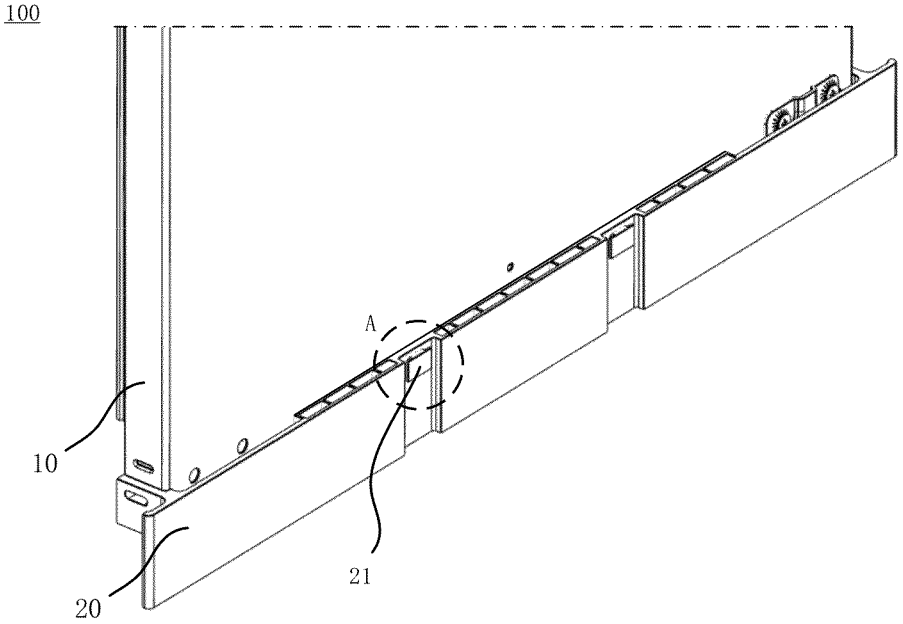
FIG. 2 is a schematic connection view of the refrigerator door and front baffle in the refrigerator door assembly shown in FIG. 1.
Figure 3:
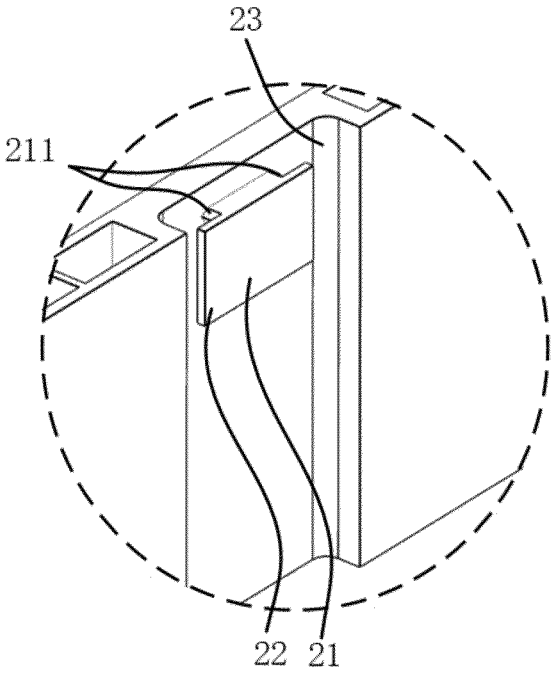
FIG. 3 is a schematic enlarged view of part A of the front baffle shown in FIG. 2.
Figure 4:
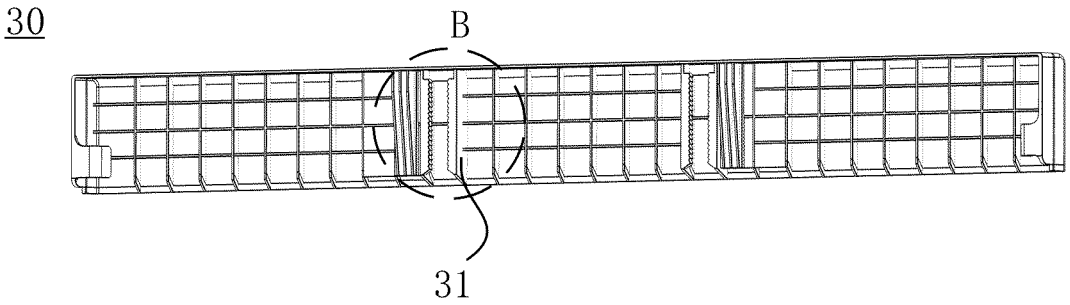
FIG. 4 is a schematic structural view of the kick plate in the refrigerator door assembly according to an embodiment of the present invention.
Figure 5:
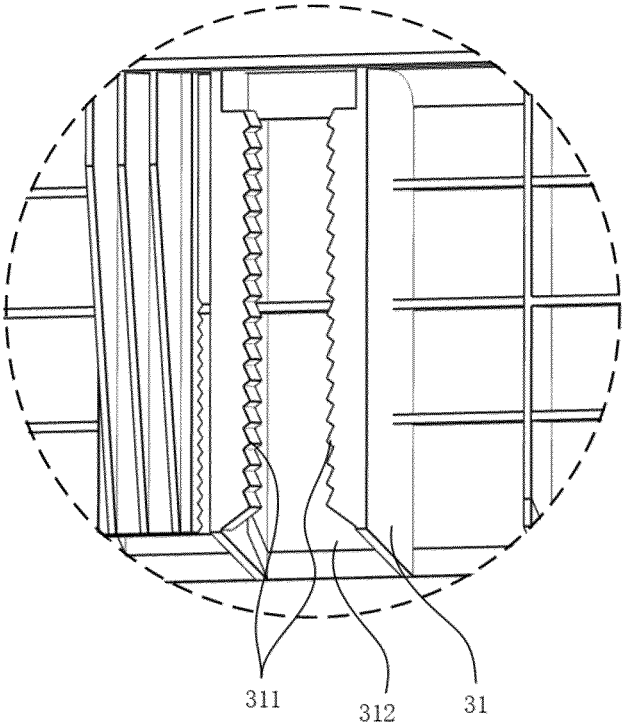
FIG. 5 is a schematic enlarged view of part B of the front baffle shown in FIG. 4.

FIG. 2 is a schematic connection view of the refrigerator door 10 and the front baffle 20 in the refrigerator door assembly 100 shown in FIG. 1. FIG. 3 is a schematic enlarged view of part A of the front baffle 20 shown in FIG. 2. FIG. 4 is a schematic structural view of the kick plate 30 in the refrigerator door assembly 100 according to an embodiment of the present invention. FIG. 5 is a schematic enlarged view of part B of the front baffle 20 shown in FIG. 4. As shown in FIGS. 2, 3, 4, and 5, and referring to FIG. 1, in one embodiment, the surface of the front baffle 20 away from the refrigerator door 10 is provided with at least one protrusion 21. The protrusion 21 is provided with a first gear structure 211 on each side along the width direction of the refrigerator door 10. A surface of the kick plate 30 facing the front baffle 20 has a catch portion 31 provided in one-to-one correspondence with each protrusion 21, and each of catch portions 31 is provided with a second gear structure 311 that cooperates with the first gear structure 211 to realize the connection of the front baffle 20 and the kick plate 30 through the combination of the first gear structure 211 and the second gear structure 311. This embodiment uses a gear structure to connect the front baffle 20 and the kick plate 30, making installation convenient, and the structure is simple without occupying additional space.

In a preferred embodiment, a surface of a side of the front baffle 20 backing away from the refrigerator door 10 is provided with at least one recessed first slide groove 23. Each first slide groove 23 is correspondingly set with the protrusion 21, and the protrusion 21 is located within the first slide groove 23. This embodiment sets the protrusion 21 within the first slide groove 23, allowing the catch portion 31 to be concealed within the first slide groove 23 when the kick plate 30 is connected to the front baffle 20. This reduces the thickness after the installation of the kick plate 30 and the front baffle 20 and enhances the aesthetic appearance.

Furthermore, the first gear structure 211 and the second gear structure 311 are configured to only allow the kick plate 30 to move upwards relative to the front baffle 20. The installation height of the kick plate 30 can be adjusted based on the position of the second gear structure 311 relative to the first gear structure 211. Specifically, both the first gear structure 211 and the second gear structure 311 include multiple vertically arranged inclined teeth, and each inclined teeth comprises a short side and a long side, with the short side located at the lower end of the long side, so as to allow the second gear structure 311 to slide upwards relative to the first gear structure 211 but prevent downward movement, effectively prevent the kick plate 30 from sliding down during use, thereby enhance user experience. In one embodiment, the short side forms a 60° angle with the vertical.

Additionally, the protrusion 21 is provided with a limiting block 22, which protrudes from a side surface provided with the first gear structure 211. The catch portion 31 is provided with a first limiting slot 312 that cooperates with the limiting block 22, used to restrict the position of the kick plate 30 relative to the front baffle 20 when the kick plate 30 moves to abut the limiting block 22 at the first limiting slot 312. This serves as a positioning function when connecting the kick plate 30 and the front baffle 20.

Figure 6:
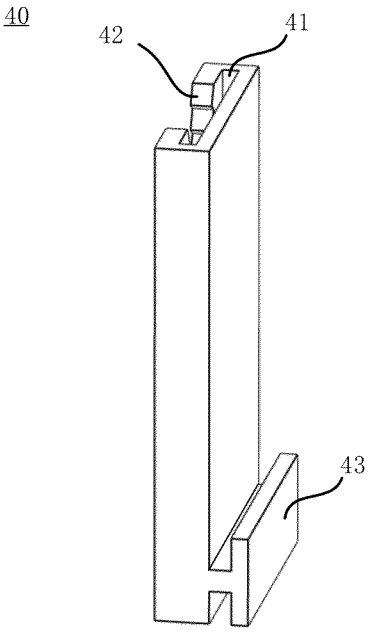
FIG. 6 is a schematic structural view of a clip according to an embodiment of the present invention.
Figure 7:
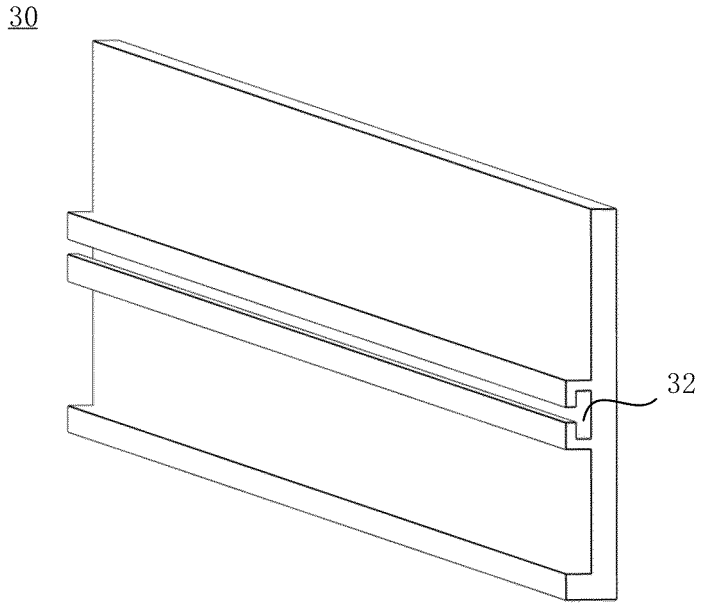
FIG. 7 is a schematic structural view of the kick plate in the refrigerator door assembly according to another embodiment of the present invention.
Figure 8:
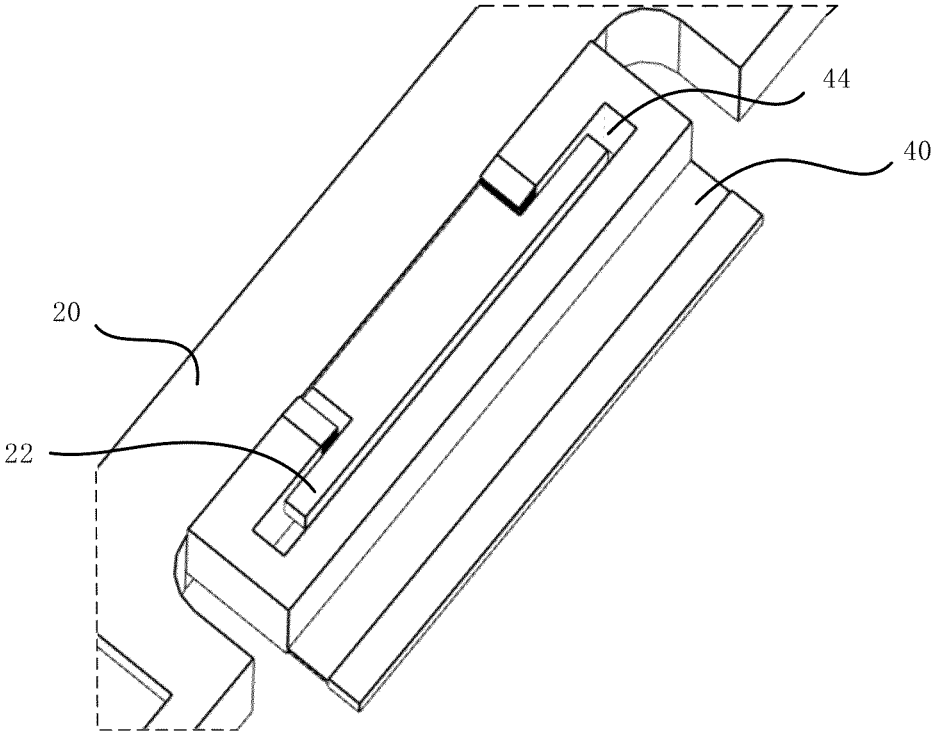
FIG. 8 is a schematic connection view of the clip and the front baffle according to an embodiment of the present invention.

FIG. 6 is a schematic structural view of a clip 40 according to an embodiment of the present invention. FIG. 7 is a schematic structural view of the kick plate 30 in the refrigerator door assembly 100 according to another embodiment of the present invention. FIG. 8 is a schematic connection view of the clip 40 and the front baffle 20 according to an embodiment of the present invention. As shown in FIGS. 6, 7, and 8, in another embodiment, a surface of the front baffle 20 away from the refrigerator door 10 is provided with at least one protrusion 21. The protrusion 21 is provided with a first gear structure 211 on each side along the width direction of the refrigerator door 10. Each clip 40 is correspondingly set with each protrusion 21, and a surface of a side of the clip 40 facing the front baffle 20 is provided with a groove 41. The groove 41 is provided with a third gear structure 42 that cooperates with the first gear structure 211 to realize the connection of the clip 40 with the front baffle 20 through the combination of the first gear structure 211 and the third gear structure 42. The clip 40 is provided with a slider 43 on a surface of a side of the clip 40 backing away from the front baffle 20, and the kick plate 30 has a second slide groove 32 that corresponds with the slider 43 to realize the connection of the kick plate 30 with the clip 40 through the engagement of the slider 43 and the second slide groove 32. This embodiment, by using the clip 40 to connect the front baffle 20 and the kick plate 30, simplifies the structure of the kick plate 30, thereby simplifies the manufacturing process of the kick plate 30, and the installation or removal of the clip 40 and the kick plate 30 is relatively convenient.

Furthermore, the first gear structure 211 and the third gear structure 42 are configured to only allow the kick plate 30 to move upwards relative to the front baffle 20. The installation height of the kick plate 30 can be adjusted based on the position of the third gear structure 42 relative to the first gear structure 211. Specifically, both the first gear structure 211 and the third gear structure 42 include multiple vertically arranged inclined teeth, and each inclined teeth comprises a short side and a long side, with the short side located at the lower end of the long side, so as to allow the third gear structure 42 to slide upwards relative to the first gear structure 211 but prevent downward movement, effectively prevent the kick plate 30 from sliding down during use, thereby enhance user experience. In one embodiment, the short side forms a 60° angle with the vertical.

In a preferred embodiment, a surface of a side of the front baffle 20 backing away from the refrigerator door 10 is provided with at least one recessed first slide groove 23. Each first slide groove 23 is correspondingly set with the protrusion 21, and the protrusion 21 being located within the first slide groove 23. The embodiment sets the protrusion 21 in the first slide groove 23, so that the clip 40 can be hidden in the first slide groove 23 when the clip 40 is connected to the front baffle 20, which ultimately reduces the thickness of the kick plate 30 when installed with the front baffle 20, and looks more beautiful.

In another preferred embodiment, the protrusion 21 is provided with a limiting block 22, which protrudes from a side surface provided with the first gear structure 211. The clip 40 is provided with a second limiting slot 44 that cooperates with the limiting block 22, used to restrict the position of the clip 40 relative to the front baffle 20 when the clip 40 moves to abut the limiting block 22 at the second limiting slot 44. This serves as a positioning function when connecting the kick plate 30 and the front baffle 20.

Further, the kick plate 30 is configured to cover the front baffle 20 after being connected with the front baffle 20. Specifically, the kick plate 30 can conceal the left and right sides, front side, and top end of the front baffle 20. From an external viewpoint, only the kick plate 30 is visible, which enhances the aesthetic appeal of the refrigerator door 10. In this context, the front baffle 20 is fixed to the refrigerator door 10 with screws, and the screw holes on the refrigerator door 10 are elongated, allowing for front-to-back adjustment of the front baffle 20.

Additionally, a refrigerator is provided in the present invention, equipped with the refrigerator door assembly 100 as described in any of the above embodiments. For the refrigerator door assembly 100, specific details are not reiterated here.

Figure 9:
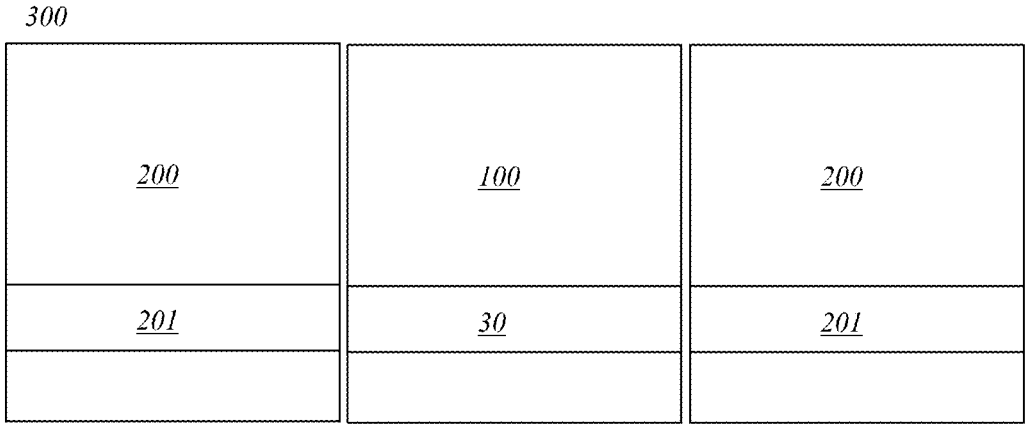
FIG. 9 is a schematic connection view of an integrated cupboard according to an embodiment of the present invention.

Moreover, FIG. 9 is a schematic connection view of an integrated cupboard according to an embodiment of the present invention. The present invention also offers an integrated cupboard 300 that includes cupboard bodies 200 and the aforementioned refrigerator. The cupboard bodies 200 includes kick plates 201. When the refrigerator door assembly 100 of the refrigerator is in a closed state, its kick plate 30 is flush with or recessed into the kick plates 201 of the cupboard bodies 200 on both sides.

The present invention provides two technical solutions for installing the kick plate 30 with the front baffle 20. One method is to connect the front baffle 20 and the kick plate 30 using the clip 40, which allows for compatibility with existing kick plates 30 available on the market. In this method, the clip 40 is first slid from a lower end to an upper end of the front baffle 20 to connect with it. Then, the kick plate 30 is slid along a side surface of the clip 40 to achieve connection with the clip 40. The other method involves directly connecting the kick plate 30 with the front baffle 20 by sliding the kick plate 30 from a lower end to an upper end of the front baffle 20. In this case, the kick plate 30 is a part of the refrigerator provided by the manufacturer, which, compared to the existing kick plates on the market, requires a redesigned structure. However, its installation and adjustment method is the same as that used with the clip 40.

To this end, those skilled in the art should recognize that although this document has exhaustively shown and described several exemplary embodiments of the invention, many other variations or modifications that conform to the principles of the present invention can be directly determined or derived from the disclosed content without departing from the spirit and scope of the invention. Therefore, the scope of the invention should be understood and recognized as covering all such other variations or modifications.

The invention claimed is:

1. A refrigerator door assembly, comprising:

a refrigerator door;

a front baffle, provided at a lower end of the refrigerator door and located on an outside of the refrigerator door;

a kick plate, provided on one side of the front baffle away from the refrigerator door and connected to the front baffle, to move with the refrigerator door when it opens, the kick plate is detachably connected to the front baffle, and the kick plate is connected to the front baffle either directly or via at least one clip;

a surface of the front baffle away from the refrigerator door is provided with at least one protrusion, and the protrusion is provided with a first gear structure on each side along the width direction of the refrigerator door; the surface of the kick plate facing the front baffle has a catch portion provided in one-to-one correspondence with each protrusion, and each of the catch portions is provided with a second gear structure that cooperates with the first gear structure to realize the connection of the front baffle and the kick plate through the combination of the first gear structure and the second gear structure;

or a surface of the front baffle away from the refrigerator door is provided with at least one protrusion, and the protrusion is provided with a first gear structure on each side along the width direction of the refrigerator door; each clip is correspondingly set with each protrusion, and a surface of a side of the clip facing the front baffle is provided with a groove, the groove is provided with a third gear structure that cooperates with the first gear structure to realize the connection between the clip and the front baffle through the combination of the first gear structure and the third gear structure; the clip is provided with a slider on a surface of a side of the clip backing away from the front baffle, and the kick plate has a second slide groove that cooperates with the slider to realize the connection of the kick plate with the clip through the engagement of the slider and the second slide groove.

2. The refrigerator door assembly according to claim 1, wherein the installation position of the front baffle is adjustable along a thickness direction and a height direction of the refrigerator door.

3. The refrigerator door assembly according to claim 2, wherein the kick plate is configured to cover the front baffle after being connected with the front baffle.

4. The refrigerator door assembly according to claim 1, wherein a surface of a side of the front baffle away from the refrigerator door is provided with at least one recessed first slide groove, each first slide groove is correspondingly set with the protrusion, and the protrusion is located within the first slide groove.

5. The refrigerator door assembly according to claim 1, wherein the first gear structure and the second gear structure are configured to only allow the kick plate to move upwards relative to the front baffle.

6. The refrigerator door assembly according to claim 1, wherein the protrusion is provided with a limiting block, which protrudes from a side surface provided with the first gear structure; the catch portion is provided with a first limiting slot that cooperates with the limiting block, used to restrict the position of the kick plate relative to the front baffle when the kick plate moves to abut the limiting block at the first limiting slot.

7. A refrigerator, wherein the refrigerator is equipped with the refrigerator door assembly as described in claim 1.

8. An integrated cupboard, comprising:

cupboard bodies, the cupboard bodies comprise kick plates, and the refrigerator according to claim 7, and when the refrigerator door assembly of the refrigerator is in the closed state, its kick plate is flush with or recessed into the kick plates of the cupboard bodies on both sides.

* * * * *